US006341611B1

(12) United States Patent
Nakamura

(10) Patent No.: US 6,341,611 B1
(45) Date of Patent: Jan. 29, 2002

(54) HAIRBRUSH

(76) Inventor: Tetsigi Nakamura, 3400-1, Tabeta, Kawanabe-cho, Kawanabe-gun, Kagoshima-ken 897-0221 (JP)

( * ) Notice: Subject to any disclaimer, the term of this patent is extended or adjusted under 35 U.S.C. 154(b) by 0 days.

(21) Appl. No.: 09/650,020

(22) Filed: Aug. 28, 2000

(30) Foreign Application Priority Data

Aug. 27, 1999 (JP) ..... 11-240952
Nov. 26, 1999 (JP) ..... 11-336043
Mar. 15, 2000 (JP) ..... 2000-072603

(51) Int. Cl.[7] ..... A45D 24/16
(52) U.S. Cl. ..... 132/120; 132/150
(58) Field of Search ..... 132/120, 122, 132/150; D4/117, 138, 128, 133

(56) References Cited

U.S. PATENT DOCUMENTS 1,370,649 A * 3/1921 Hope ..... 132/120
D127,804 S * 6/1941 Kahn ..... D4/138
2,263,475 A * 11/1941 Strauch ..... 132/120
2,272,151 A * 2/1942 Hertzberg ..... 132/120
2,507,373 A * 5/1950 Finkelstein ..... 132/120
2,515,094 A * 7/1950 Price ..... 132/120
2,532,505 A * 12/1950 Love ..... 132/120
2,602,457 A * 7/1952 Mele ..... 132/120
2,610,637 A * 9/1952 Fuentes ..... 132/120
2,685,292 A * 8/1954 Staiano ..... 132/120
2,799,283 A * 7/1957 Kapusnyk ..... 132/120
3,180,342 A * 4/1965 Dietsche ..... 132/120
3,690,331 A * 9/1972 Messer ..... 132/120
D244,728 S * 6/1977 Kael ..... D4/138
5,979,463 A * 11/1999 Santy, III et al. ..... 132/120

* cited by examiner

*Primary Examiner*—Todd E. Manahan
(74) *Attorney, Agent, or Firm*—Koda & Androlia

(57) ABSTRACT

A hairbrush including a brush portion formed by implanting thick and hard bristles in at least two parallel, adjacent longitudinally extending lines on a brush base such that frictional resistance between the brushing portion and hair is reduced and that the hair can pass smoothly through the brushing portion and a tension applying portion formed by implanting bundles of thin and elastic bristles in at least two parallel, adjacent longitudinally extending lines on a side of said brushing portion in a circumferential direction such that frictional resistance between the tension applying portion and the hair is increased to apply tension to the hair.

6 Claims, 19 Drawing Sheets

HAIRBRUSH

BACKGROUND OF THE INVENTION

1. Field of the Invention

The present invention relates to a hairbrush having three functions and more particularly to a hairbrush used for brushing to comb hair, blow-drying to stretch hair and add luster to the hair using warm air from a hair dryer, and curling to give curl to hair by using warm air from the hair dryer.

2. Description of Prior Art

A hairbrush generally comprises thick and hard bristles provided sparsely on a semicylindrical brush base. This semicylindrical brush base is to reduce frictional resistance between the bristles and the hair, thus facilitating passage of the hair and preventing damage to the hair. Moreover, in most hairbrushes, the hard bristles and the brush base are made of synthetic resin so as to reduce frictional resistance between the hard bristles and brush base and the hair.

For blow-drying, a hairbrush in which thick and hard bristles are implanted in a semicylindrical brush base made of soft resin such as silicon rubber or made of rubber is used. Hair is pushed against the brush base such that the hair is brought into contact with the brush base so as to apply tension to the hair by frictional resistance between the brush base and the hair. Another Type of hairbrush having about three times as many thick and hard bristles as the hairbrush for brushing to increase the frictional resistance between the hard bristles and the hair is also used. With these hairbrushes, the tension is applied to the hair by frictional resistance while the hair is exposed to warm air from hair dryer to stretch the hair, thus adding luster to the hair.

However since the thick and hard bristles and made of synthetic resin, the tension is less likely to be applied to the hair. In a case of curly hair, the hair slips and a state in which the hair is applied with tension is likely to be broken and it is difficult to straighten the hair. Therefore, strong blow-drying cannot be applied.

There is a roll bristle brush formed by implanting animal hair in bunches on a brush base formed of a round rod so as to form a roll-shaped brush. This roll bristle brush can apply strong blow- drying. However, frictional resistance between the brush and the hair is too large, and the hair cannot pass smoothly.

In order to curl long hair such as woman's hair, a side portion of the hairbrush formed of hard bristles is used. The hair is bent while the tension is applied to the hair, and the hair is curled while the bent portion of the hair is exposed to warm air from a hair dryer. However, there is no hairbrush that can apply a tension that is strong enough to cause the hair to bite into the side portion of the hairbrush.

In order to curl short hair such as man's hair, a hairbrush for brushing is used to comb and arrange the hair. Then, the hair is caught and bent by a hairbrush for setting in which animal hair is implanted in bunches and the bent portion is exposed to the warm air from a hair dryer to give curl to the hair.

With the hairbrush for brushing, it is possible to comb the hair; but it is difficult to catch and bend the short hair or to suppress springing up of the hair. On the other hand, with the hairbrush for setting made of animal hair, the end of the animal hair cannot reach scalp, and it is impossible to comb the hair.

Furthermore, when curling short hair using two hairbrushes, one for brushing and one for setting as in a conventional manner, it is impossible to catch the hair by the hairbrush for setting immediately after combing and arranging the hair by the hairbrush for brushing. Therefore, the hair is likely to be disarranged, and it is necessary to change the hairbrush from one to the other many times.

As described above, because to hairbrushes described above respectively have different functions, it is necessary to use a plurality of hairbrushes in combination to apply desired treatment to the hair.

The hair has a property of softening when warmed and a property of hardening when cooled. Therefore, it is possible to correct curl of the hair or to curl the hair by straightening or bending the hair by using the hairbrush when the hair is warmed and cooling the hair as it is to allow the hair to harden. The stronger the tension applied to the hair by the hairbrush is in warming or cooling the hair, the more the hair is stretched and the easier the curl of the hair can be corrected or the hair can be curled. Therefore, a hairbrush that can apply strong tension has been desired.

SUMMARY OF THE INVENTION

Therefore, it is an object of the present invention to provide a hairbrush that can be used for brushing, blow-drying, and curling and can apply strong tension to the hair.

The hairbrush of the present invention comprises a brushing portion and a tension applying portion; and the brushing portion is formed by implanting thick and hard bristles on a brush base such that the frictional resistance between the brushing portion and hair is reduced and the hair can pass smoothly through the brushing portion; and the tension applying portion is formed by implanting thin and elastic bristles next to the brushing portion in the circumferential direction such that the frictional resistance between the tension applying portion and hair is increased so as to apply tension to the hair.

As a result, because of the tension applying portion that is right next to the brushing portion, it is possible to immediately apply tension to the hair by using the tension applying portion without shifting the hairbrush from one hand to the other. Moreover, because the tension applying portion is formed by implanting the thin and elastic bristles and the frictional resistance between the tension applying portion and the hair is large when the hair bites into the tension applying portion, a strong tension can be applied to the hair.

According to the present invention, in addition to the structure described above, brush bristles are provided throughout the outer peripheral face in a circumferential direction of the brush base, so that about a half of the brush bristles are the hard bristles to form the brushing portion and the rest of the bristles are the thin and elastic bristles to form the tension applying portion.

As a result, it is possible to freely change the amount of hair biting into the tension applying portion.

Furthermore, in the present invention the tension applying portions are formed in opposite side positions of the brush base which face each other.

The tension applying portions on the opposite sides can be properly used depending on the circumstances.

Furthermore, the present invention provides a hairbrush wherein a small gap is provided between the brushing portion and the tension applying portion. Also, bunches of the tension applying portion may be implanted so as to be inclined and a small gap may be provided between the tension applying portion and the brushing portion.

As a result, the tension applying portion positioned on the front side does not accidentally tangle with the hair when the hairbrush is pulled forward for blow-drying or curling the long hair. Thus, the hairbrush is easy to use.

Furthermore, the present invention provides a hairbrush wherein the brush base is a cylindrical column, and the brush bristles are provided throughout the outer peripheral face in the circumferential direction of the brush base, with the part of the brush bristles being the thin and elastic bristles to form the tension applying portion and the rest of the brush bristles being the hard bristles to form the brushing portion.

As a result, the tension applying portion can be positioned on either side of the brushing portion when the brush base is rotated and the position of the tension applying portion is changed. Thus, it is easy to use the hairbrush.

Moreover, the present invention provides a hairbrush wherein the brush base has a semicylindrical shape, and the tension applying portions are provided on both sides of the brush base, with the bristles at the one tension applying portion being long, and the bristles at the other tension applying portion being short.

As a result, it is possible to use different elasticity of the tension applying portions by changing the tension applying portion to use.

Furthermore, the present invention provides a hairbrush wherein the handle portions are provided on both sides of the brush base so as to be on the tip end side and on the base end side.

As a result, by changing the handle portion to hold from one to the other, the orientations of the tension applying portions are changed, and the tension applying portion that is closer to a person applying the treatment to the hair is changed (positions of the portions are reversed). Therefore, the bristles of different length can be used.

Still furthermore, the present invention provides a hairbrush wherein the bristles in the tension applying portions are animal hair, and the bristles are not cut at tip ends thereof to the same length.

As a result, biting of the bristles into the hair is facilitated.

DETAILED DESCRIPTION OF THE PREFERRED EMBODIMENTS

Embodiments of the present invention will be described below based on the accompanying drawings.

First Embodiment

Figure 1:
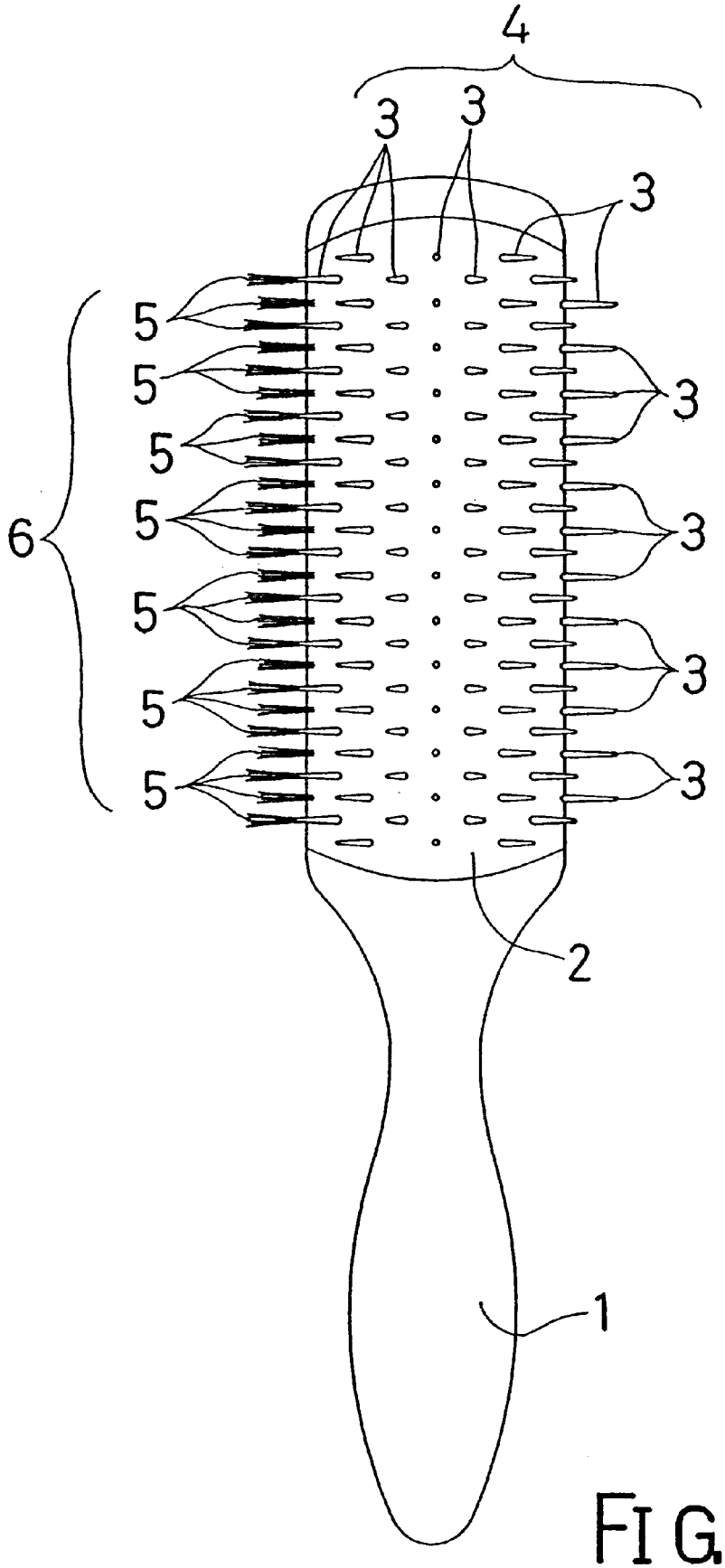
FIG. 1 is a front view of the hairbrush according to the first embodiment of the present invention.
Figure 2:
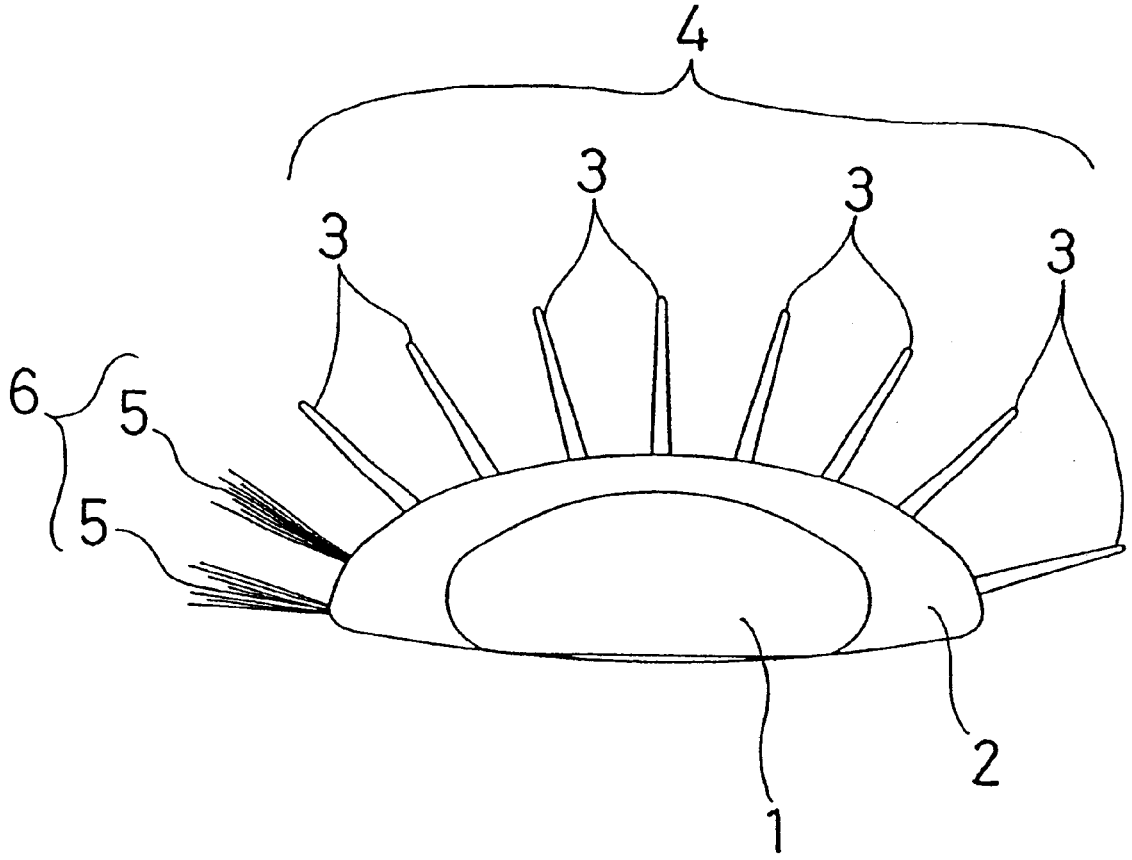
FIG. 2 is a bottom view showing the hairbrush of the first embodiment of the present invention.

FIG. 1 is a front view of the hairbrush of the first embodiment of the present invention, and FIG. 2 is a bottom view thereof.

The hairbrush has a handle portion 1 made of synthetic resin and a brush base 2 connected to the handle portion 1. The brush base 2 is formed into a semicylindrical shape in which the upper face is curved such that the longitudinal center portion is higher than other portions. A brushing portion 4 is formed in a portion except for the longitudinal left side portion of the brush base 2. In this brush portion 4, thick and hard bristles 3 made of synthetic resin are mounted to stand sparsely such that the frictional resistance between the brushing portion 4 and hair is reduced (or low) so as to facilitate passage of the hair. A tension applying portion 6 in which thin and elastic bristles 5 are implanted is formed in the left side portion of the brush base 2. In this tension applying portion 6, the frictional resistance between the tension applying portion 6 and the hair is increased (or high) and tension is applied to the hair when the hair is combed because the hair bites into between the bristles 5 implanted on the brush base 2.

It is preferable that the bristles 5 implanted in the brush base 2 are not cut at tip ends thereof to the same length but have various lengths to facilitate biting of the bristles 6 into the hair.

Although the bristles 5 are implanted in two lines in the side portion of the brush base 2 to form the tension applying portion 6 in this embodiment, the number of lines may be changed arbitrarily according to the required strength of tension. A part of the bristles 5 may be inclined toward the backside so as to increase a degree of biting of the hair.

The hard bristles 3 may be formed integrally with the brush base 2 or may be formed separately and implanted on the brush base 2.

It is preferable that animal hair such as bristles of a pig or a wild boar which do not soften due to heat when heated by a hair dryer is used for the bristles 5 in the tension applying portion 6 because the bristles 5 are exposed to warm air from hair dryer in blow-drying. Bristles made of synthetic resin may be used in the tension applying portion 6. If the bristles made of synthetic resin are used, the bristles may be formed integrally with the brush base 2.

The hairbrush of the first embodiment is used as described below.

a. In Brushing

The handle portion 1 is held such that the tension apply portion 6 of the hairbrush is oriented downward, and the hairbrush is inclined such that the brushing portion 4 slightly faces downward. The hair is thus combed using the brushing portion 4.

b. In Blow-drying

The handle portion 1 is held such that the tension applying portion 6 of the hairbrush is oriented upward, the hair is taken by the brushing portion 4 and placed securely on the brush base 2, and the handle portion 1 is rotated one-quarters of a turn to catch the hair by the bristles 5 in the tension applying portion 6.

At this time, the hair bites into the bristles 5 of the tension applying portion 6, and the tension is applied to the hair.

Rotation of the handle portion 1 is stopped, and the hairbrush is pulled straight toward the end of the hair while the hair is exposed to the warm air from the hair dryer. Then, the tension is applied to the hair while the hair is combed by the brushing portion 4. Therefore, the hair can be blow-dried smoothly without getting tangled.

c. In Curling

First, the hair is combed and arranged by the brushing portion 4.

Next, the handle portion 1 is held by hand such that the tension applying portion 6 of the hairbrush is oriented upward, the root side of the hair is brushed by the brushing portion 4 while the handle portion 1 is rotated slightly upward to catch the root side of the hair by the tension applying portion 6, and then the hair is placed securely on the brushing portion 4. At this time, the hair bites slightly into the tension applying portion 6, and weak tension is applied to the hair.

Figure 3:
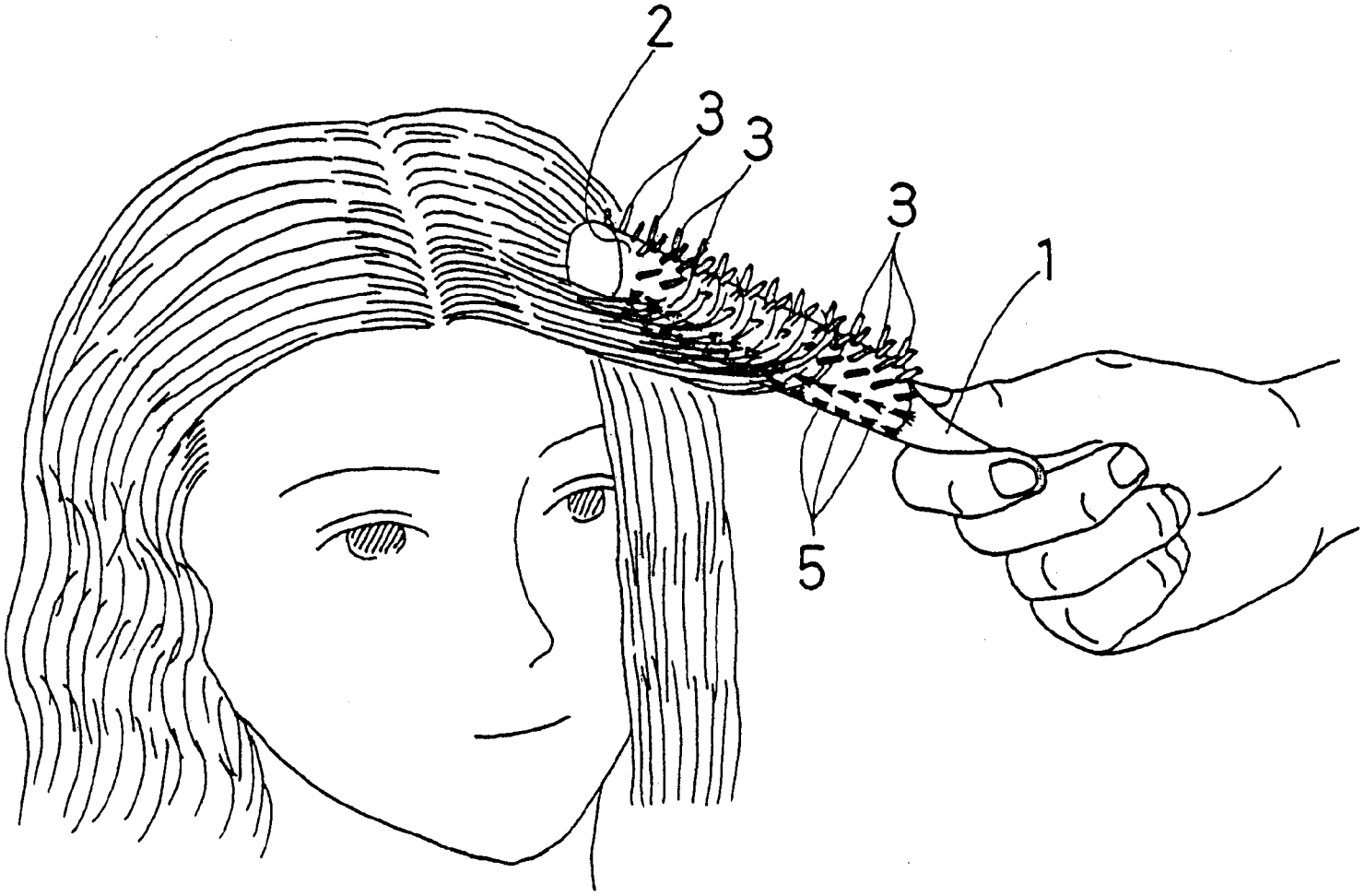
FIG. 3 is an explanatory view showing the usage of the hairbrush of the embodiment of the present invention.

If the hairbrush is slid toward the end of the hair, and the handle portion 1 is rotated further upward at a portion of the hair to be curled in this state, then the hair further bites into the tension applying portion 6, and the state shown in FIG. 3 is obtained.

While gradually rotating the hairbrush further upward, the hair biting into the tension applying portion 6 is exposed to the warm air from the hair dryer, and the hairbrush is moved toward the end of the hair to continue to apply the treatment until the hairbrush reaches the end of the hair. As a result, a curl with a large diameter is given to the hair.

If the hairbrush is pulled toward the front in FIG. 3 from the state shown in FIG. 3, the hair further bites into the bristles 5 in the tension applying portion 6, and a large tension is applied to the hair.

With a large tension being applied to the hair, the hairbrush is gradually rotated upward, and the hair biting into the tension applying portion 6 is exposed to the warm air from the hair dryer so as to continue applying the treatment until the hairbrush reaches the end of the hair. By way of this treatment, a strong curl with a small diameter can be given to the hair.

In the above state of the large tension to the hair, if the rotation of the hairbrush is stopped and the hair is exposed to the warm air from hair dryer for a longer time, a strong curl with a smaller diameter can be obtained.

The bristles 5 in the tension applying portion 6 are implanted in bunches and the roots of the bristles 5 are close in each bunch. Accordingly, the hair bites into the bunches to a small extent when the hair is combed normally. However, if the brush is rotated, the hair bites deep into the bunches, and strong tension is applied to the hair.

Although the tension applying portion 6 is formed on the left side portion of the brush base 2 in this embodiment, the tension applying portion 6 may be formed on the right side portion.

Second Embodiment

Figure 4:
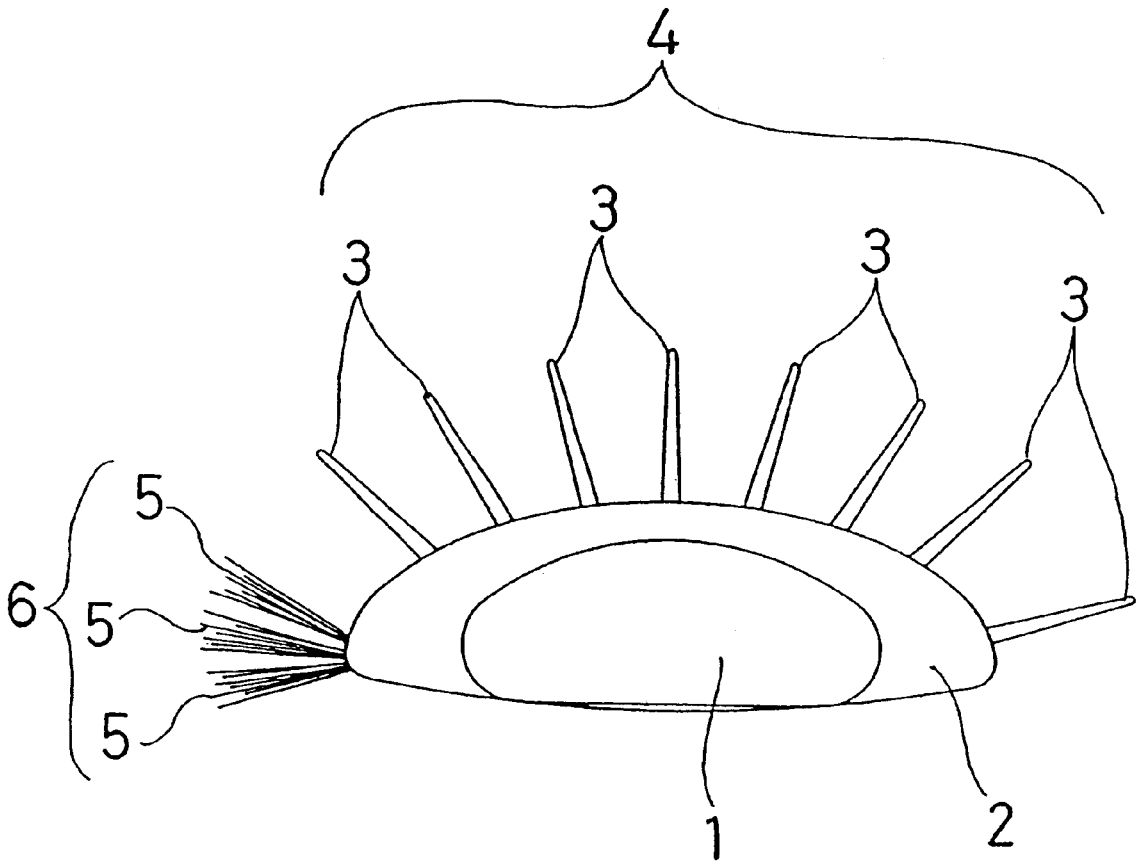
FIG. 4 is a bottom view of the hairbrush of the second embodiment of the invention.

As seen from FIG. 4, in the second embodiment, the bristles 5 oriented toward the backside of the brush back 2 are provided in the tension applying portion 6. More bristles 5 are provided in the tension applying portion 6 than the above embodiment. The amount of biting of the hair into the bristles when the hairbrush is rotated upward is large, and a strong tension can be applied to the hair.

Since other structures and usage of the hairbrush are similar to those in the first embodiment, the description thereof is omitted.

Third Embodiment

Figure 5:
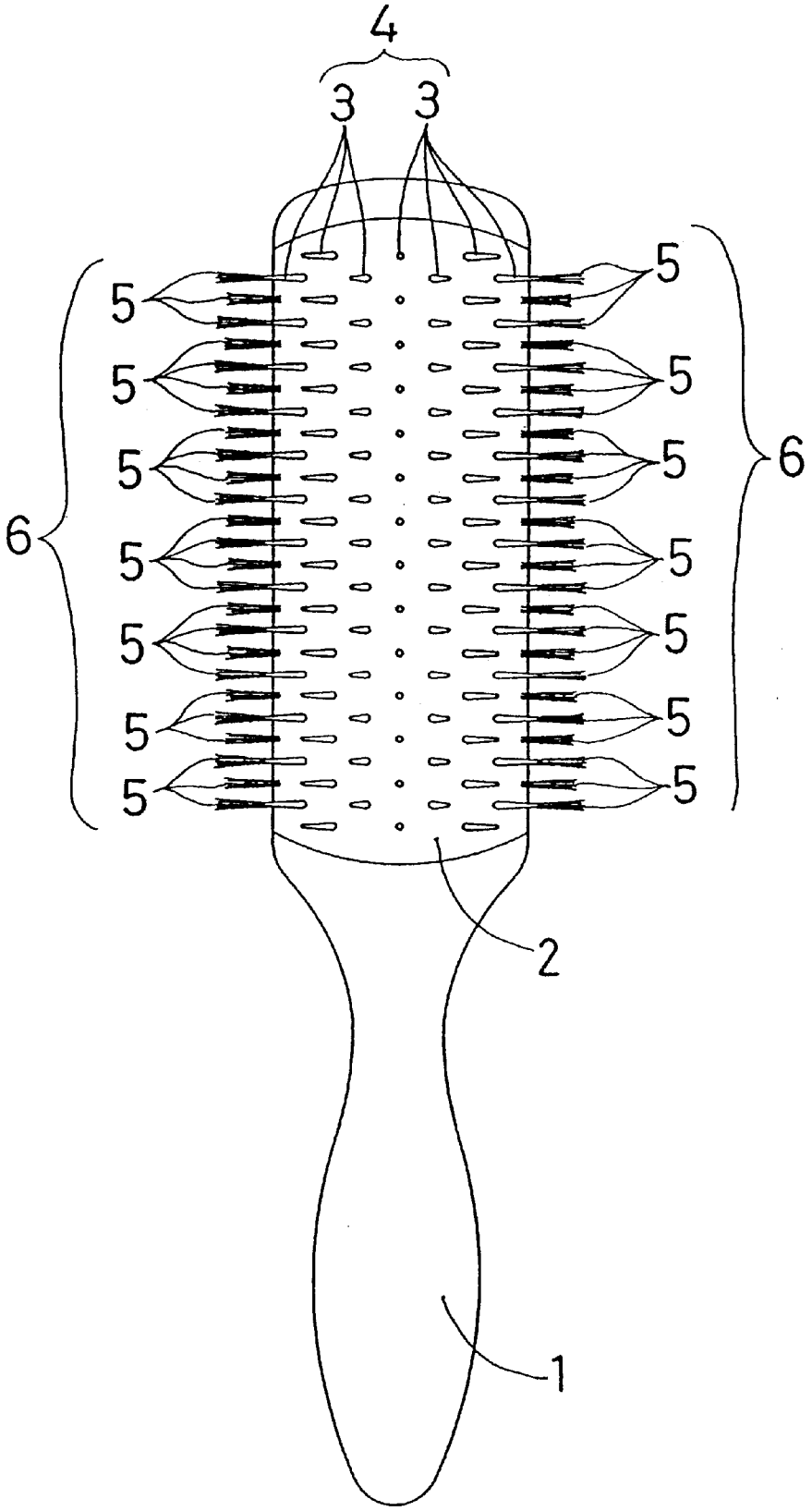
FIG. 5 is a front view of the hairbrush of the third embodiment of the invention.
Figure 6:
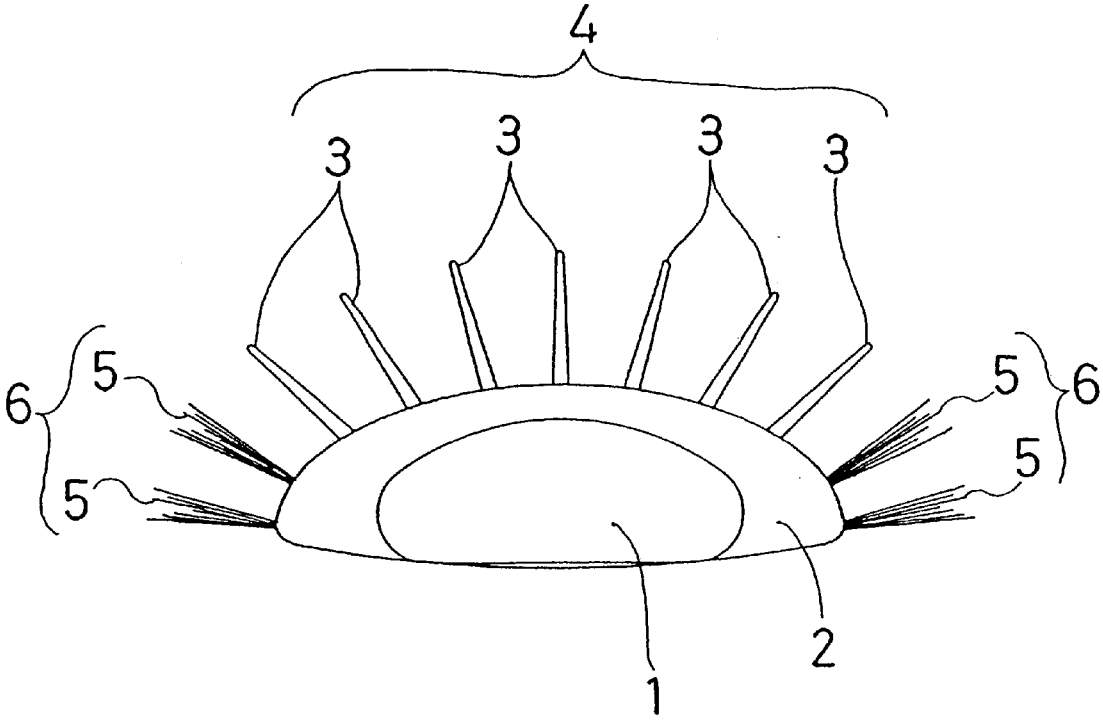
FIG. 6 is a bottom view of the hairbrush of the third embodiment of the present invention.

In the third embodiment, the tension applying portions 6 are formed on both side portions in the longitudinal direction of the brush base 2. FIG. 5 is a front view of the third embodiment, and FIG. 6 is a bottom view thereof.

In the first and second embodiments, because the tension applying portion 6 is formed only on one side portion and the side for applying the tension is fixed, two hairbrushes for right-handed and left-handed persons are necessary. In this third embodiment, however, the tension applying portions 6 are formed on both left and right side portions such that the tension applying portion 6 on either side portion can be used. Thus, only one hairbrush is necessary.

Since other structures and usage of the hairbrush are similar to those in the first embodiment, the description thereof is omitted.

Fourth Embodiment

Figure 7:
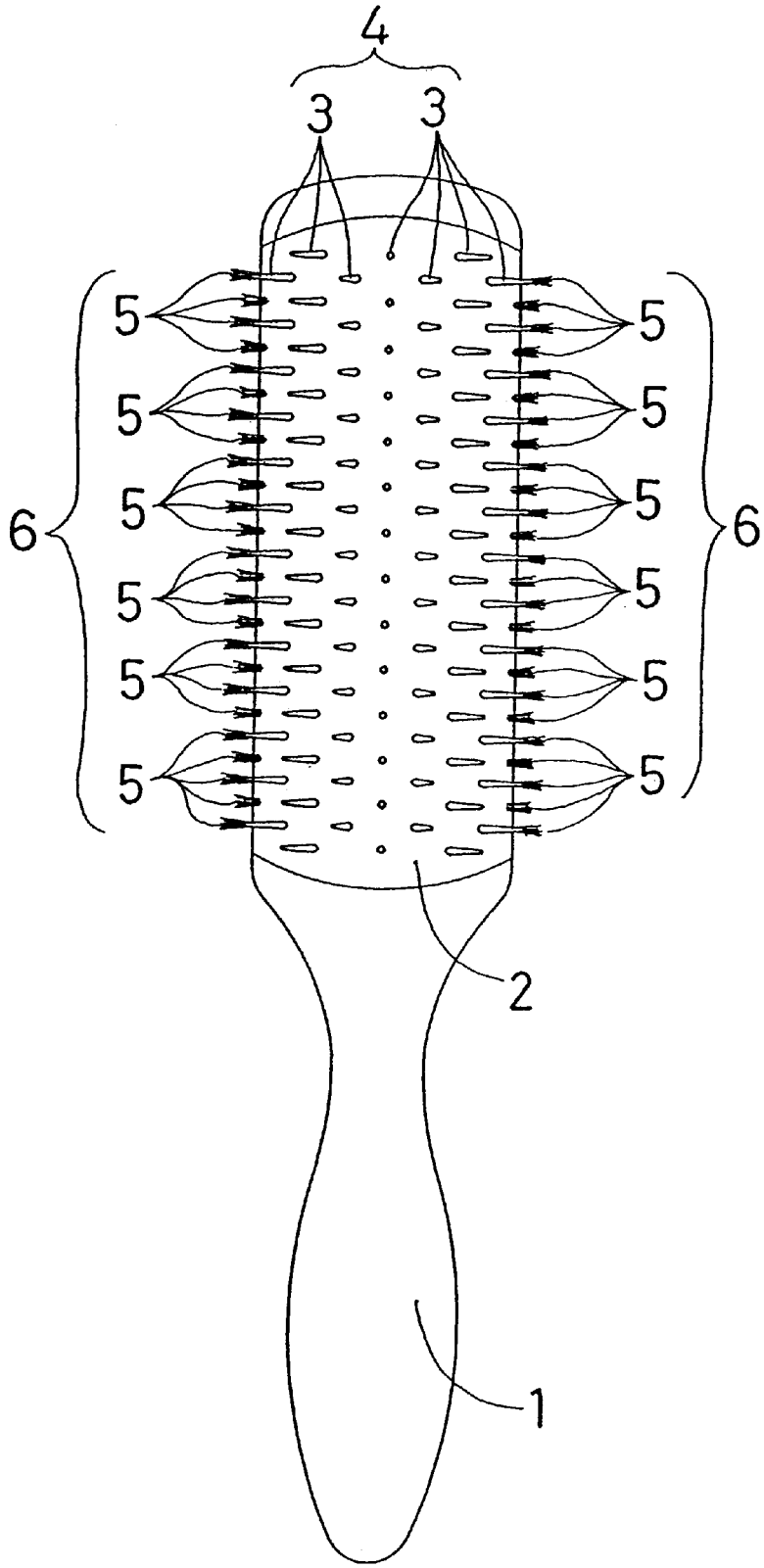
FIG. 7 is a front view of the hairbrush of the fourth embodiment of the present invention.
Figure 8:
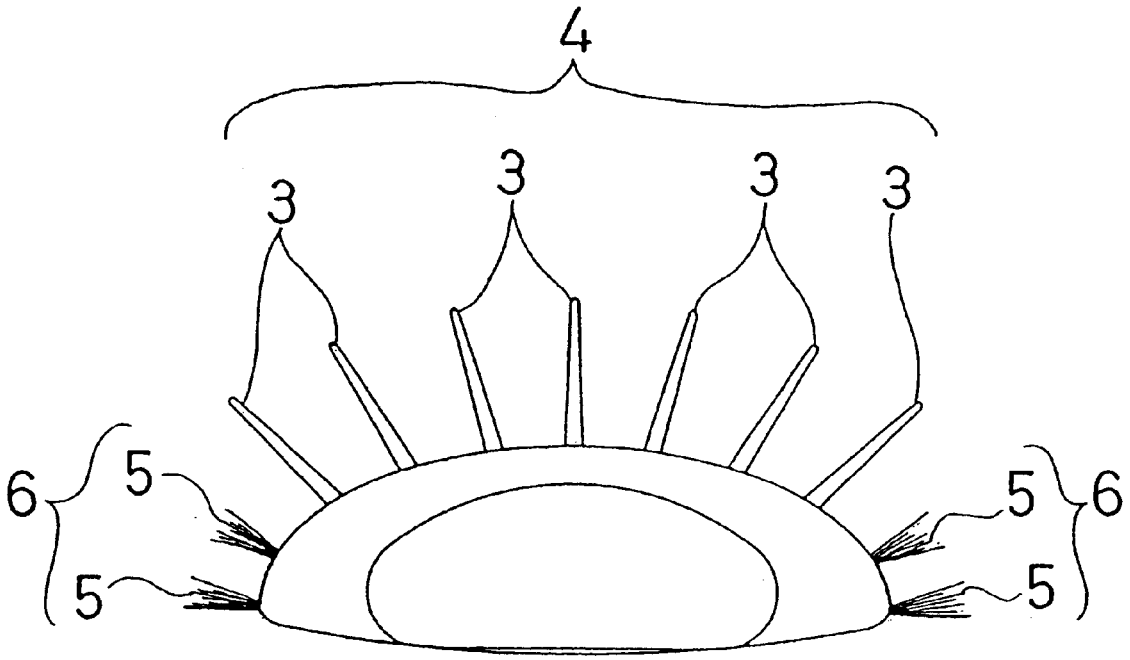
FIG. 8 is a bottom view of the hairbrush of the fourth embodiment of the present invention.

In the fourth embodiment, the tension applying portions 6 are formed at both side portions in the longitudinal direction of the brush base 2 as in the third embodiment, and the bristles 5 in the tension applying portion 6 are shorter compared to the previous embodiment. FIG. 7 is a front view of the fourth embodiment, and FIG. 8 is a bottom view thereof.

The strength of blow-drying or curling changes depending on the strength of the tension applied to the hair. In other words, strong blow-drying or curling can be obtained when strong tension is applied to the hair, and weak blow-drying or curling can be obtained when weak tension is applied to the hair.

More specifically, if the lengths of the bristles in tie tension applying portion are increased, the bristles in the tension applying portion 6 touch the hair strongly. As a result, the bristles bite deep into the hair, the frictional resistance increases, and the tension applied to the hair increases.

To the contrary, if the lengths of the bristles are reduced, the amount of biting of the bristles into the hair is reduced, and the tension applied to the hair reduces.

The fourth embodiment is an example in which the lengths of the bristles 5 in the tension applying portions 6 are reduced so that weak tension is applied to the hair.

Therefore, the hairbrush of the fourth embodiment is suitable for obtaining light blow-drying and curling. Since the other structures and usage of the hairbrush are similar to those in the first embodiment, the description thereof is omitted.

Fifth Embodiment

Figure 9:
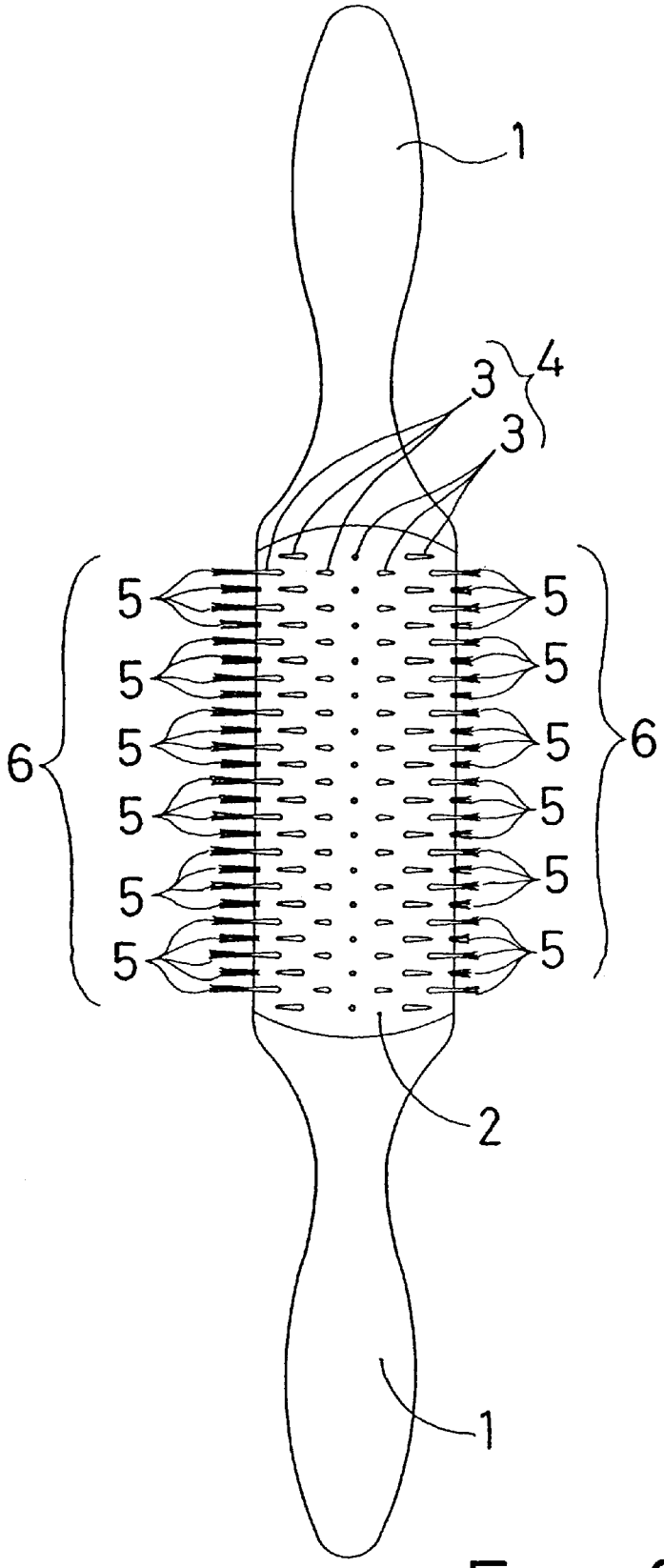
FIG. 9 is a front view of the hairbrush of the fifth embodiment of the present invention.
Figure 10:
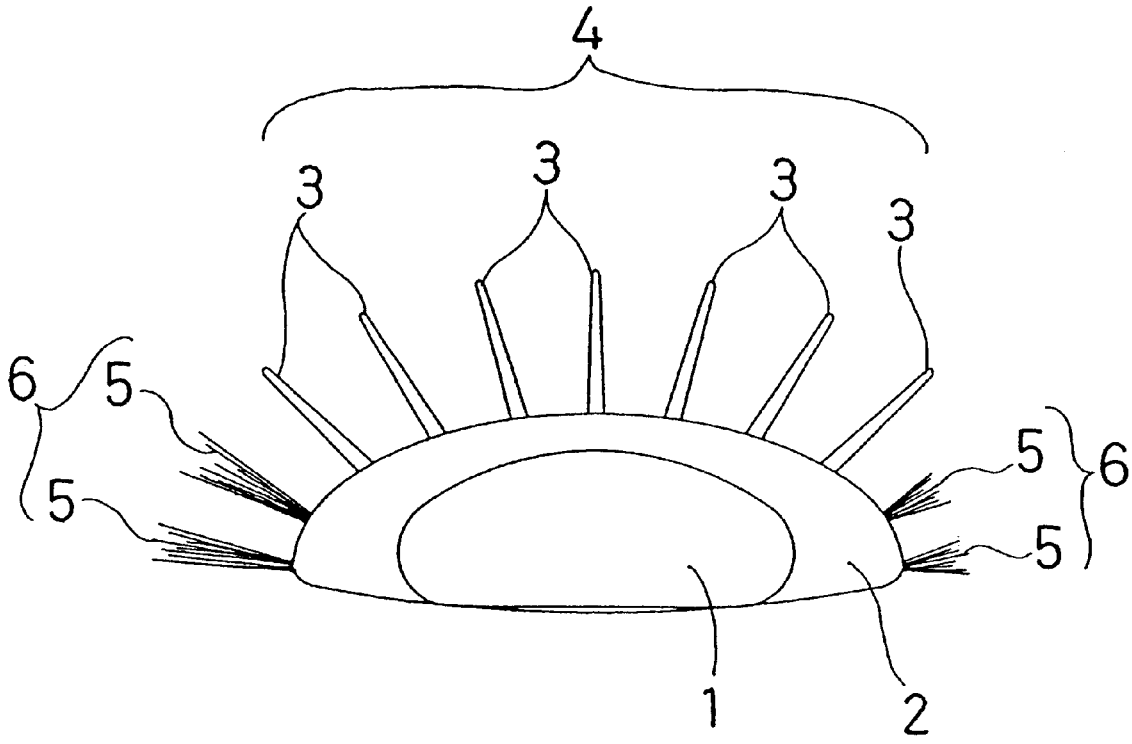
FIG. 10 is a bottom view of the hairbrush of the fifth embodiment of the present invention.

In the fifth embodiment shown in FIGS. 9 and 10, the tension applying portions 6 are formed on both side portions of the hairbrush 1 in the longitudinal direction as in the the embodiment, and the handle portions 1 are provided in the opposite sides, i.e., a tip end side and a base end side, of the brush base 2. Bristles 5 in one of the tension applying portions 6 are longer than the bristles 5 in the other. FIG. 9 shows the longer bristles 5 on the left side and the shorter bristles 6 on the right side.

With this structure, by changing the handle portion 1 to hold from the one handle portion 1 to the other, the tension applying portion 6 to be used changes from the one on the one side to the other on the other side, and the length of the bristles 5 at the tension applying portion 6 can be changed. Thus, it is possible to have different strength of the blow-drying and curling in one hairbrush.

Since the other structures and usage of the hairbrush are similar to those in the first embodiment, the description thereof is omitted.

Sixth Embodiment

Figure 11:
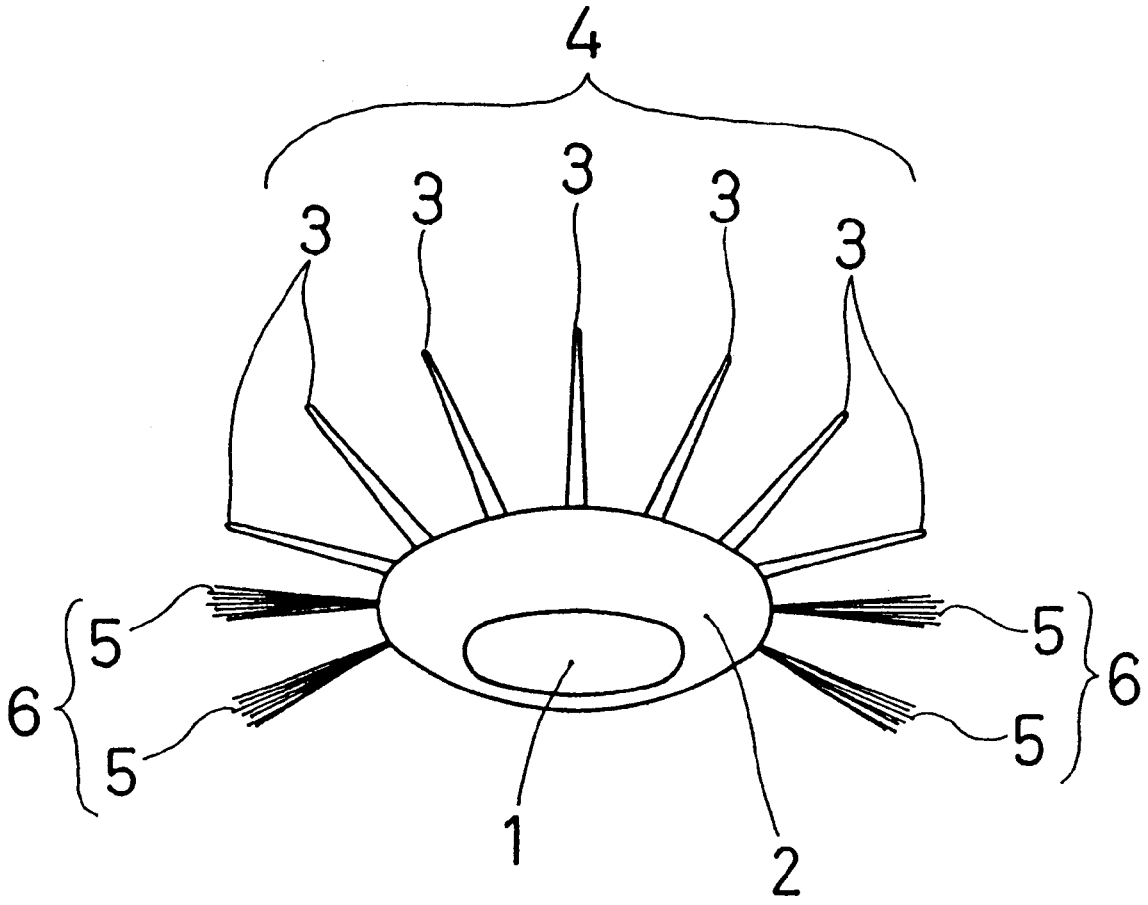
FIG. 11 is a bottom view of the hairbrush of the sixth embodiment of the present invention.

FIG. 11 is a bottom view of the sixth embodiment in which the hard bristles 3 are implanted on an upper face side of the brush base 2 to form the brushing portion 4, and the thin and elastic bristles 5 are implanted in side portions and back sides on both sides of the brush base 2 to form the tension applying portions 6.

With this structure, the bristles 5 in the tension applying portions 6 are less likely to tangle with the hair when the hair is brushed with the brushing portion 4, and it is possible to brush the hair smoothly.

The hairbrush of this embodiment is especially suitable for setting short hair. By turning the wrist while combing the hair with the brushing potion 4, the hair can be immediately caught by the tension applying portion 6. Then, when the movement Of the hairbrush is stopped and the hair is set by warm air from the hair dryer, the arranged hair is less likely to be disturbed, and it is possible to curl the hair neatly.

It is of course possible to provide the bristles 5 of the tension applying portions 6 in the backside surface of the brush base 2.

Seventh Embodiment

Figure 12:
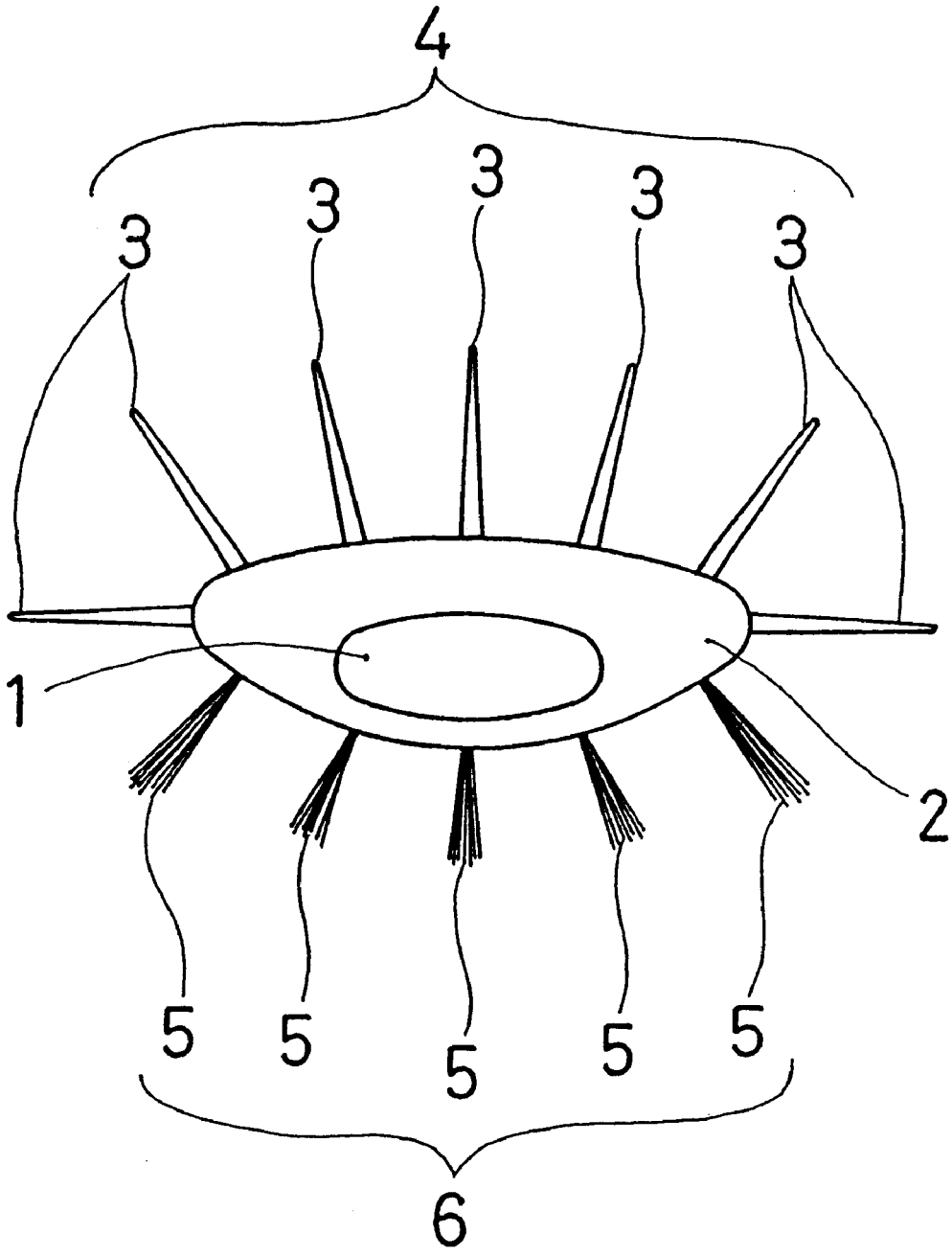
FIG. 12 is a bottom view of the hairbrush of the seventh embodiment of the present invention.

FIG. 12 is a bottom view of the seventh embodiment in which the tension applying portion 6 is formed in the entire backside face of the brush base 2.

Since other structures and usage of the hairbrush are similar to those in the sixth embodiment, the description thereof is omitted.

Eighth Embodiment

Figure 13:
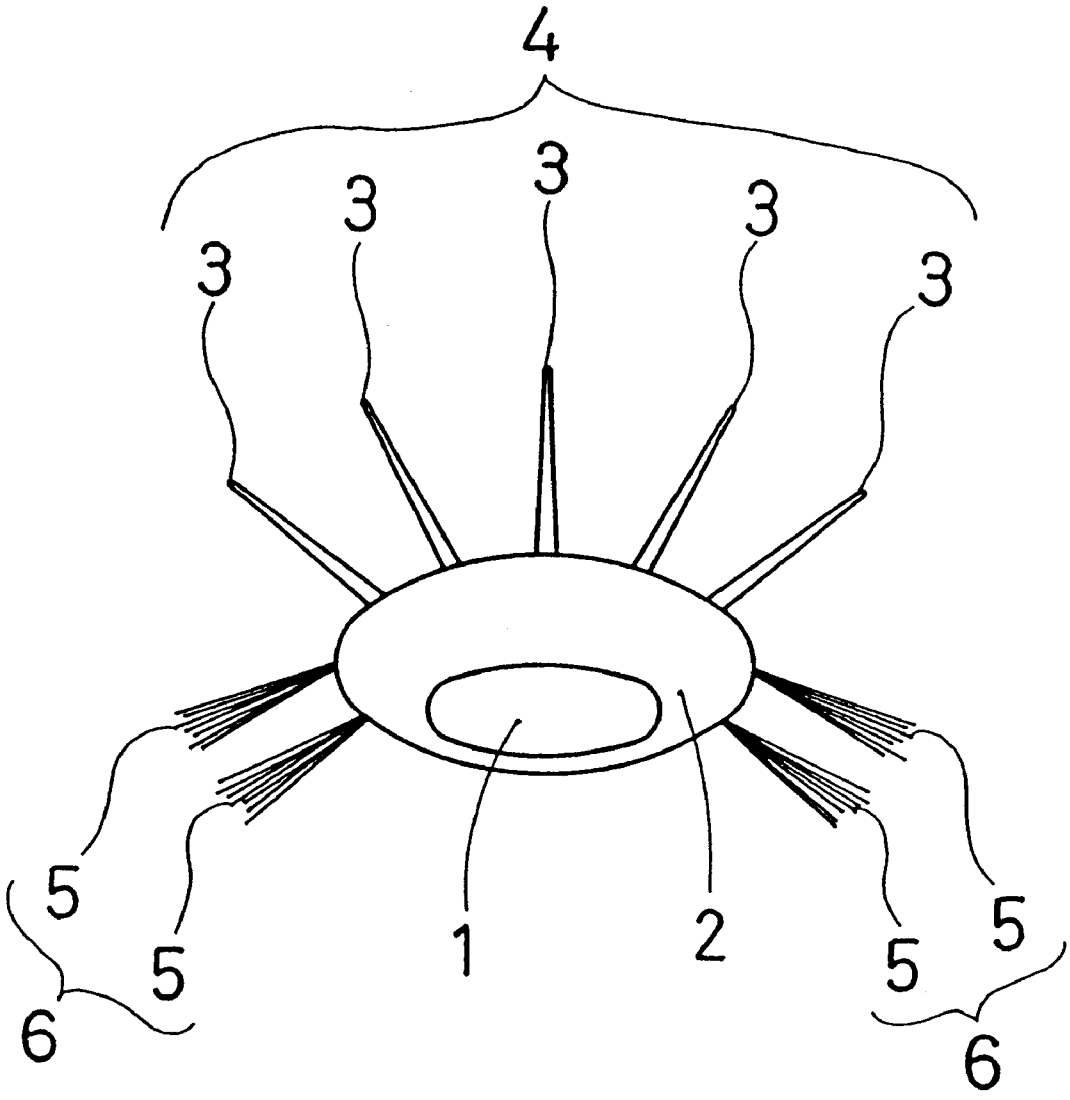
FIG. 13 is a bottom view of the hairbrush of the eighth embodiment of the present invention.

FIG. 13 is a bottom view of the eighth embodiment. The hard bristles 3 are implanted in the upper face of the brush base 2 so as to form the brushing portion 4, and the thin and elastic bristles 5 are implanted in the side portions and in the back sides on both sides of the brush base 2 to form the tension applying portions 6 as in the sixth embodiment. Long hair is more likely to tangle with the bristles 5 of the tension applying portion than short hair. Therefore, in this eighth embodiment, the bristles 5 in the tension applying portions 6 are inclined toward the backside.

Since the other structures and usage of the hairbrush are similar to those in the first embodiment, the description thereof is omitted.

Ninth Embodiment

Figure 14:
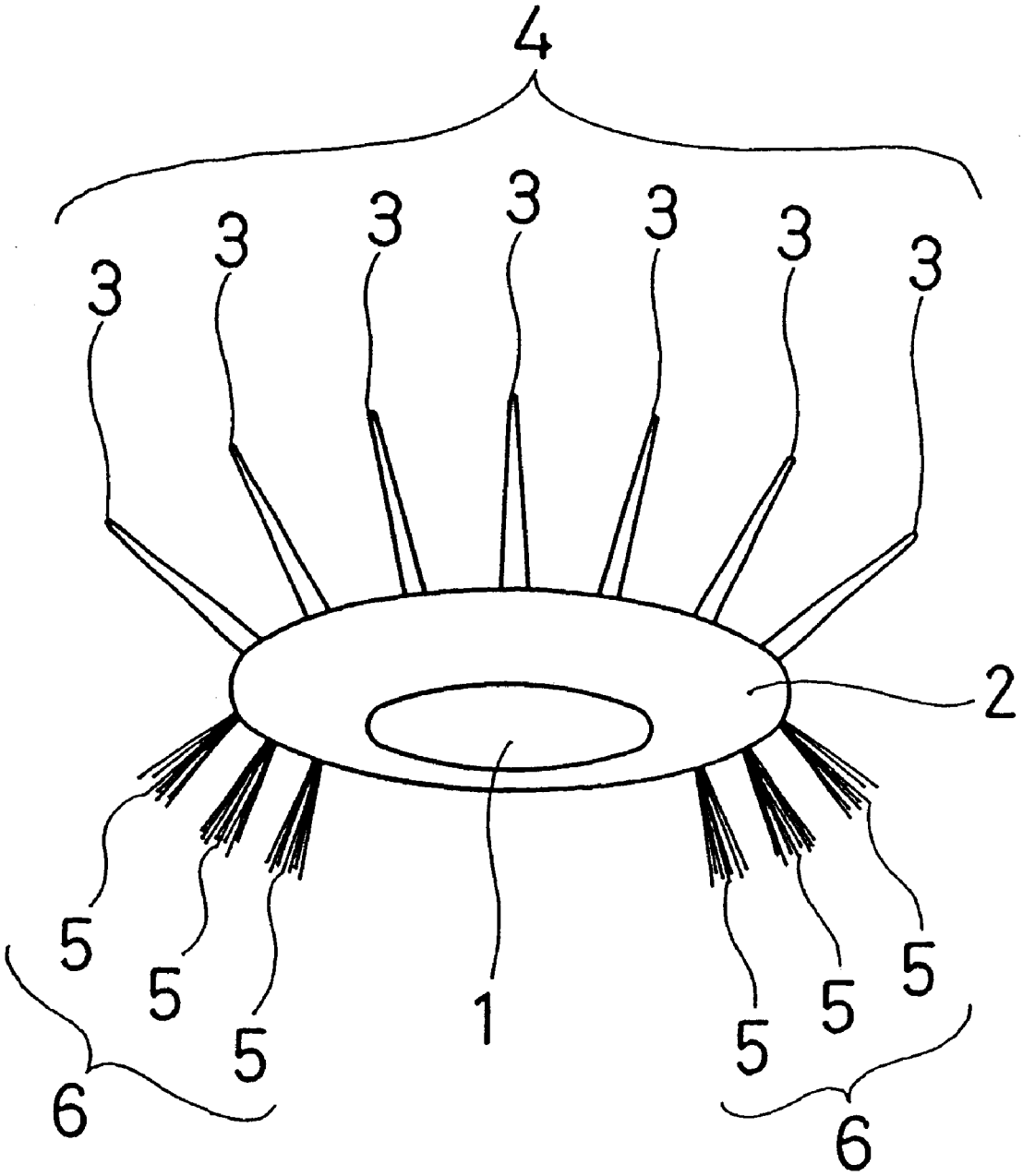
FIG. 14 is a bottom view of the hairbrush of the ninth embodiment of the present invention.

FIG. 14 is a bottom view of the ninth embodiment 9. The hard bristles 3 are implanted in the upper face of the brush base 2 so as to form the brushing portion 4, and the thin and elastic bristles 5 are implanted in the side portions and back sides on both sides of the brush base 2 so as to form the tension applying portions 6 as in the sixth embodiment. Because long hair is more likely to tangle with the bristles 5 of the tension applying portions than short hair in brushing, in this ninth embodiment, small gaps are provided between the brushing portion 4 and the tension applying portions 6.

Since the other structures and usage of the hairbrush are similar to those in the first embodiment, the description thereof is omitted.

Tenth Embodiment

Figure 15:
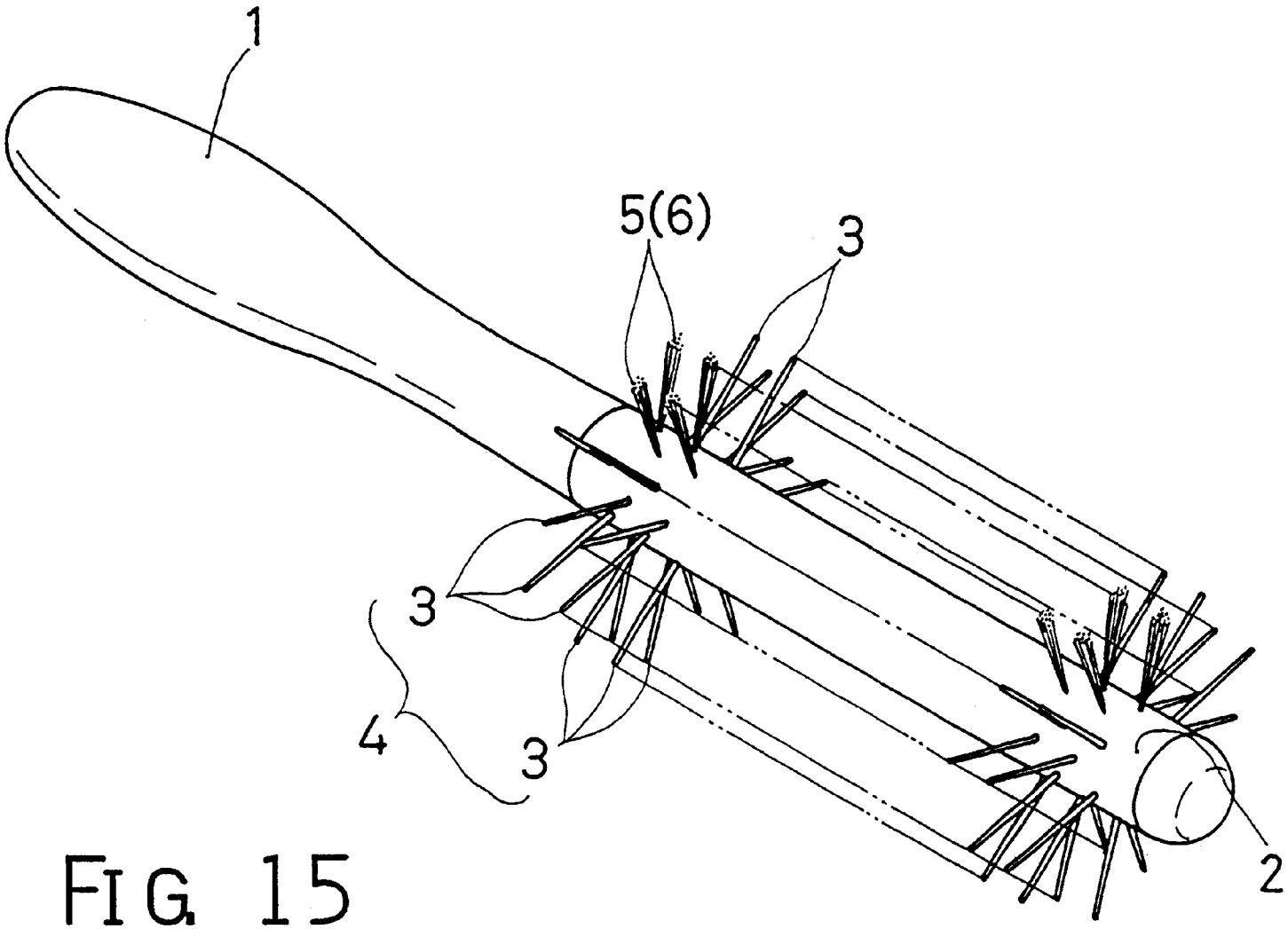
FIG. 15 is a perspective view of the hairbrush of the tenth embodiment of the present invention.
Figure 16:
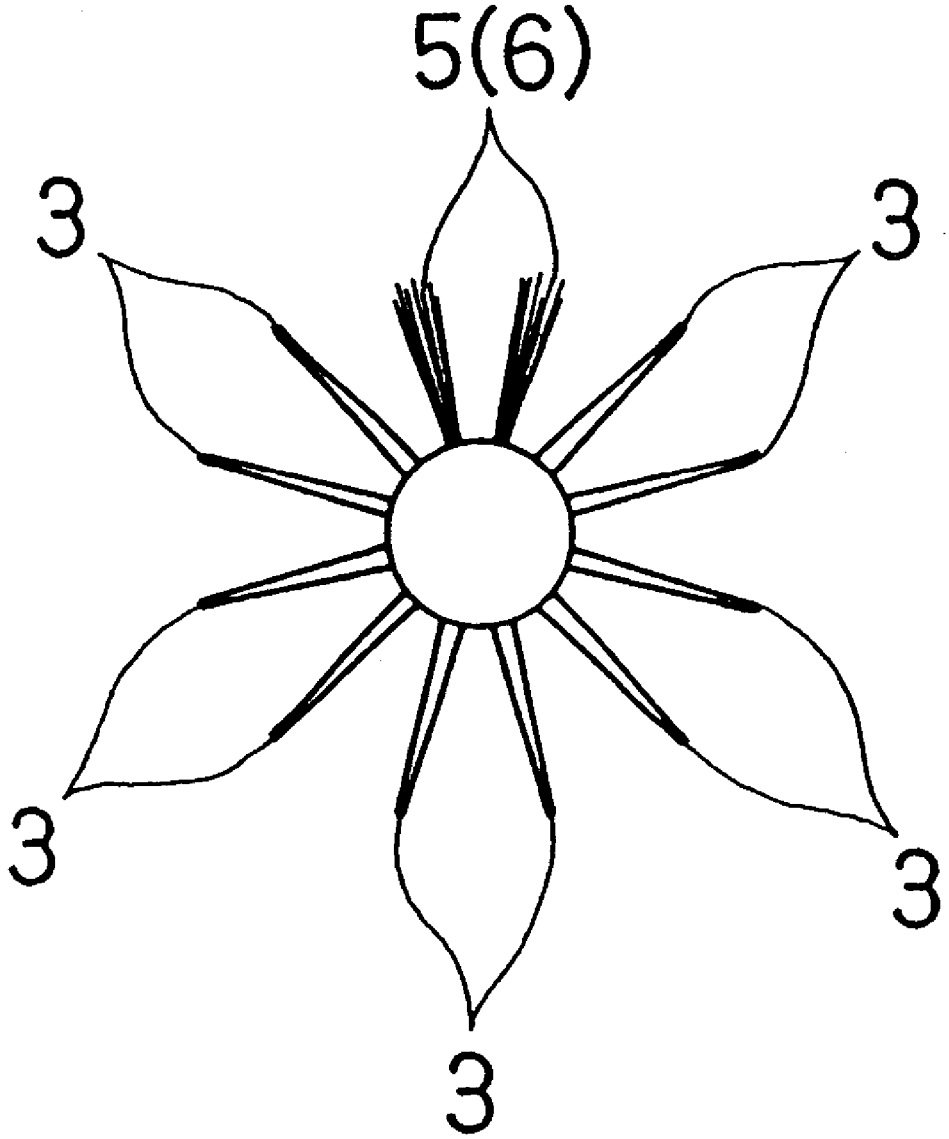
FIG. 16 is a right side view of the hairbrush of the tenth embodiment of the present invention.

FIG. 15 is a perspective view and FIG. 16 is a right side view of the hairbrush of the tenth embodiment of the present invention.

The hairbrush of this embodiment has a handle portion 1 and a brush base 2 connected to the handle portion 1. The brush base 2 is formed into a cylindrical column. Brush bristles are provided to extend radially outward throughout the outer peripheral surface in circumferential direction of the brush base 2. Furthermore, thin and elastic bristles 5 are implanted in bunches in a part of a circumferential width of the brush bristles so as to form a tension applying portion 6. Thick and hard bristles 3 are provided sparsely to stand in the rest of the circumferential width so as to form a brushing portion 4.

In the area where the thin and elastic bristles 5 are implanted in bunches, hair bites into between the bristles 5 of the bunch so as to increase the frictional resistance between the bristles 5 and the hair when the hair is combed, thus applying tension to the hair.

In the area where the thick and hard bristles 5 are provided so as to stand sparsely, the frictional resistance between the bristles 3 and the hair is reduced to facilitate passage of the hair.

It is preferable that the thin and elastic bristles 5 implanted in the brush base 2 are not cut at tip ends thereof to the same length so as to have various lengths such that the bristles 5 can easily bite into the hair.

Although the bunches formed with the thin and elastic bristles 5 are implanted in two lines in the brush base 2, the number of lines of the thin and elastic bristles 5 may be changed arbitrarily according to required strength of tension.

The hard bristles 3 may be formed integrally with the brash base 2 or may be formed separately and implanted in the brush base 2.

It is preferable that animal hair such as bristles of a pig, a wild boar, or the like which do not soften due to the heat when heated by a hair dryer is used for the thin and elastic bristles 5. This is because the bustles 5 are exposed to warm air from the hair dryer in blow-drying. Bristles made of synthetic resin may also be used instead of animal hair. If the bristles of synthetic resin are used, the bristles can be formed integrally with the brush base 2.

The hairbrush of the tenth embodiment is used as described below.

a. In Brushing

Hair is combed by using the portion of the hard bristles 3 of the hairbrush.

b. In Blow-drying

The handle portion 1 is held such that the portion of the thin and elastic bristles 5 of the hairbrush is oriented upward, hair is taken by the portion of the hard bristles 3, and the handle portion 1 is rotated after the hair is placed securely on the brush base 2 to catch the hair by the portion of the thin and elastic bristles 5.

At this time, the hair bites into the bunches of the thin and elastic bristles 5, and tension is applied to the hair.

Rotation of the handle portion 1 is stopped, and the hairbrush is pulled straight toward the end of the hair while the hair is exposed to the warm air from the hair dryer mainly at the portion of the thin and elastic bristles 5. Then, the tension is applied to the hair while the hair is combed by the hard bristles 3. Therefore, the hair can be blow-dried smoothly without getting tangled.

c. In Curling

First, the hair is combed and arranged by the portion of the hard bristles 3.

Next, the handle portion 1 is held such that the portion of the thin and elastic bristles 5 of the hairbrush is oriented upward, the root side of the hair is brushed by the portion of the hard bristles 3 while the handle portion 1 is rotated slightly to catch the root side of the hair, and then, the hair is placed securely on the brush base 2. At this time, the hair bites slightly into the bunches of the thin and elastic bristles 5 and weak tension is applied to the hair.

If the hairbrush is slid toward the end of the hair while the weak tension is applied to the hair and the handle portion 1 is rotated further upward at a portion of the hair to be curled, the hair further bites into the bunches of the thin and elastic bristles 5, and the tension applied to the hair increases.

While gradually rotating the hairbrush further, the hair is exposed to the warm air from the hair dryer mainly at the portion of the thin and elastic bristles 5, and the hair brush is moved toward the end of the hair to continue to apply the treatment until the hair brush reaches the end of the hair. As a result, a curl can be given to the hair.

If the direction in which the hairbrush is to be rotated is changed, i.e., if the direction in which the hair is curled is reversed, the treatment can be applied by using either side of the hairbrush because the hairbrush has the hard bristles 3 on both sides in the circumferential direction of the bunches of the thin and elastic bristles 5, and the treatment can be applied without shifting the hairbrush from one hand to the other.

Eleventh Embodiment

Figure 17:
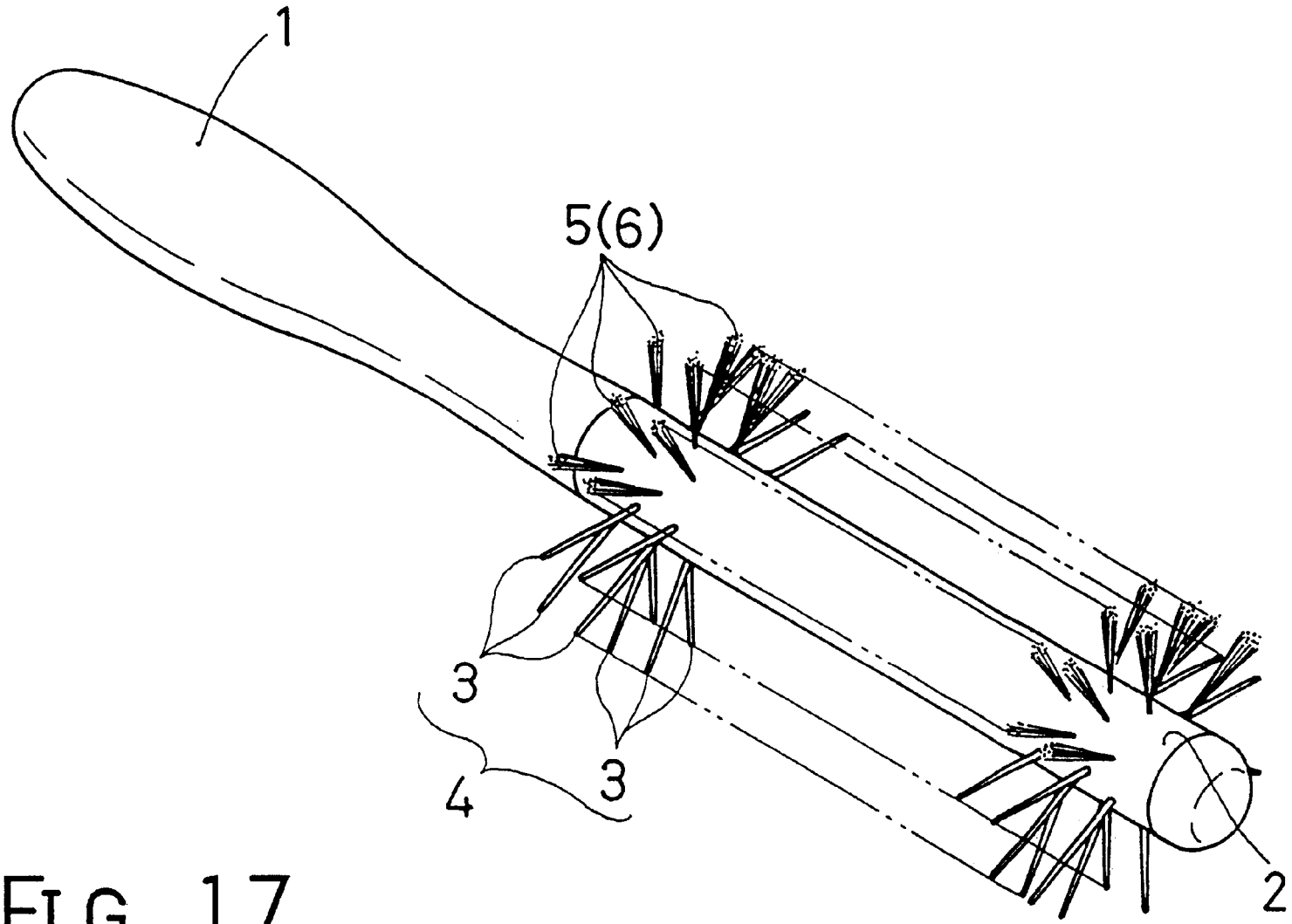
FIG. 17 is a perspective view of the hairbrush of the eleventh embodiment of the present invention.
Figure 18:
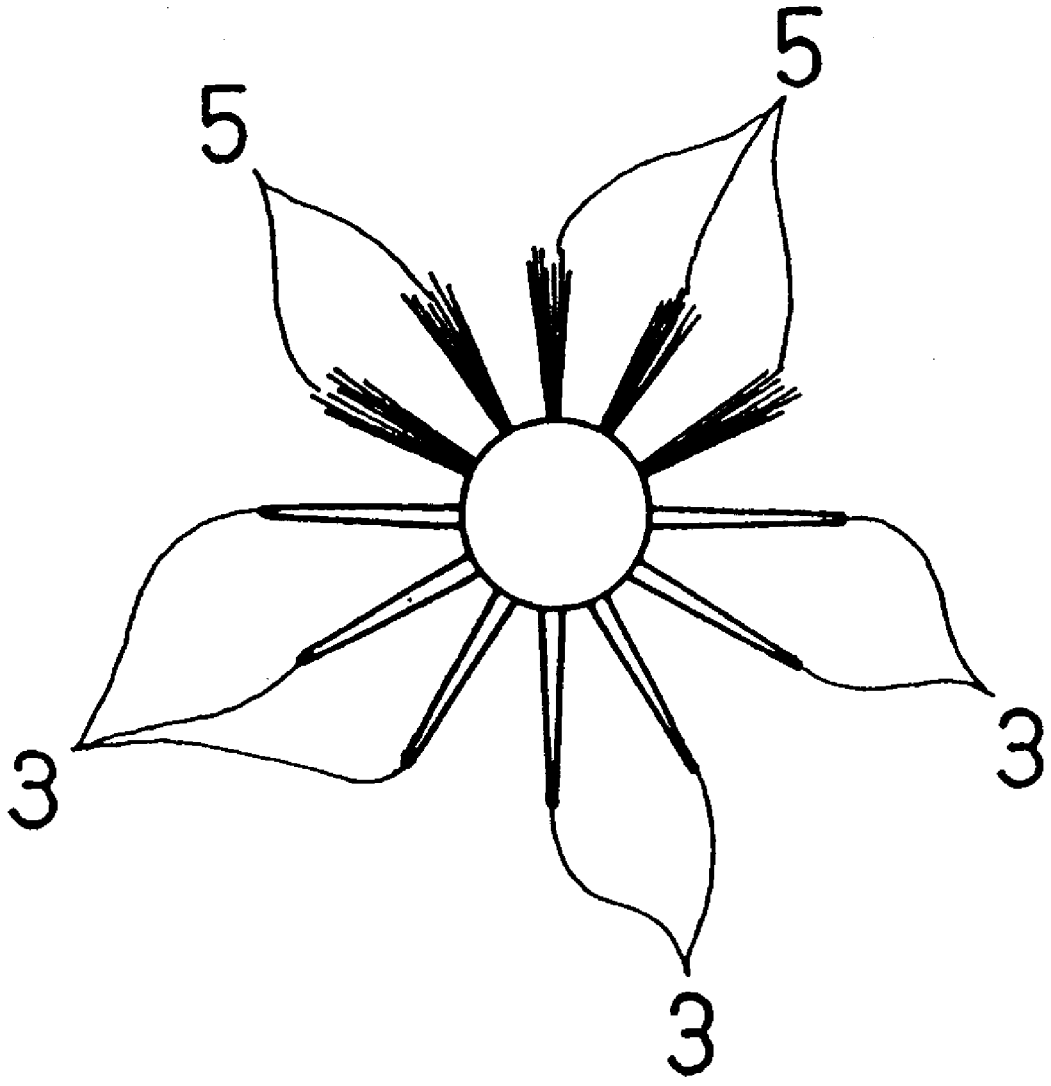
FIG. 18 is a right side view of the hairbrush of the eleventh embodiment of the present invention.

FIGS. 17 and 18 show the eleventh embodiment in which bunches formed of elastic bristles 5 are implanted in five lines in the circumferential direction of the brush base 2 to increase the width of the tension applying portion 6. By increasing the area of a portion biting into the hair, a stronger tension can be applied to the hair.

Since the other portions are similar to those in the tenth embodiment, the description thereof is omitted.

In this eleventh embodiment, although the brushing portion 4 and the tension applying portion 6 are formed close to each other, small gaps may be provided between the brushing portion 4 and the tension applying portion 6 as in the ninth embodiment.

Twelfth Embodiment

Figure 19:
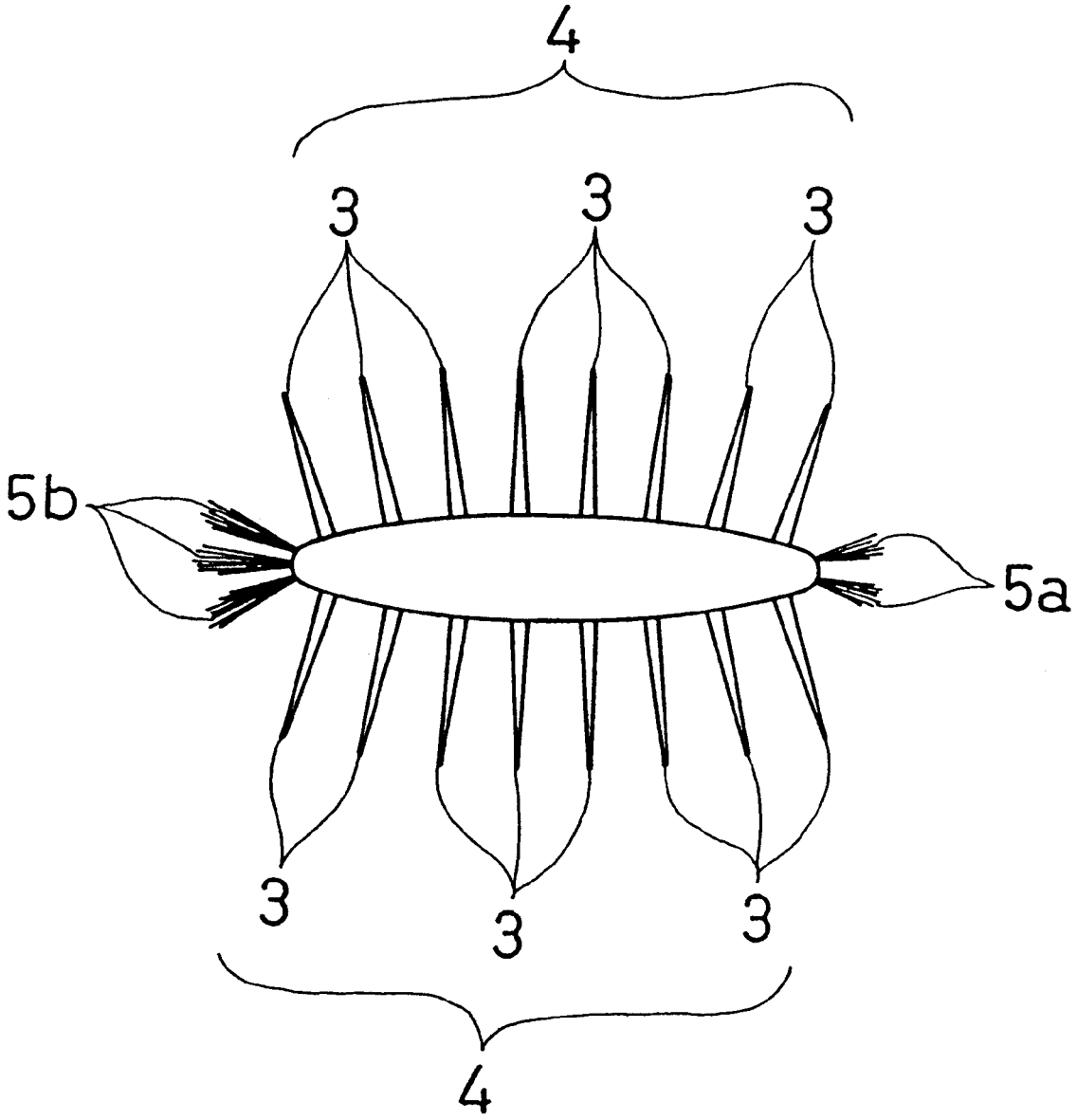
FIG. 19 is a right side view of the hairbrush of the twelfth embodiment of the present invention.

FIG. 19 shows the twelfth embodiment in which the brush base 2 has an oval sectional shape. Thin and elastic bristles 5 are implanted in both end portions in the direction of a major axis of the brush base 2, and thick and hard bristles 3 are provided to stand in the rest of the brush base 2.

As shown in FIG. 19, the thin and elastic bristles 5 on one of left and right sides are shorter and more elastic than the bristles 5 on the other side. In other words, the thin and elastic bristles 5*a* on the right side in FIG. 19 are shorter than the bristles 5*b* on the left side.

The shorter, thin, and elastic bristles 5*a* are used when the hair is curly and short and it is necessary to raise the hair by the bristles 5; while the longer bristles 5*b* are used when the hair is long and is likely to tangle with the brushing portion 4.

As described above, it is possible to change the length of the thin and elastic bristles 5 implanted in the hairbrush depending on the treatment applied to the hair or quality of the hair.

With such a structure, the length of the thin and elastic bristles 5 can be changed to change strength of the tension by only rotating the handle portion 1 and without shifting the handle portion 1 from one hand to the other. Therefore, it is possible to change strength of blow-drying or curling by one hairbrush.

Since the other structures and usage of the hairbrush are similar to those in the eleventh embodiment, the description thereof is omitted. Although two types of brush bases having circular and oval sectional shapes are described in the tenth to twelfth embodiments, the sectional shape may be a polygon such as a pentagon or a polygon with six or more sides.

Moreover, although the bristles 5 in the tension applying portion 6 are implanted in bunches (points) in the brush base 2 in the first to twelfth embodiments, the bristles 5 may be implanted straight and successively. It is also possible to mix the hard bristles 3 into the tension applying portion 6.

Furthermore, the number of lines of the hard bristles 3 in the brushing portion 4, the number of lines and the length of the bunches in the tension applying portion 6, and the sectional shape of the brush base are not limited to those described in the first to twelfth embodiments but may be changed properly and arbitrarily as long as the above operations and effects can be obtained.

As described above, the hairbrush of the present invention is convenient in which three treatments including brushing, blow-drying, and curling can be applied by one hairbrush.

What is claimed is:

1. A hairbrush comprising a brushing portion formed by implanting thick and hard bristles in at least two parallel, adjacent longitudinally extending lines on a brush base such that frictional resistance between said brushing portion and hair is reduced and that said hair can pass smoothly through said brushing portion and a tension applying portion formed by implanting bundles of thin and elastic bristles in at least two parallel, adjacent longitudinally extending lines on one side of said brushing portion in a circumferential direction such that frictional resistance between said tension applying portion and said hair is increased to apply tension to said hair.

2. The hairbrush according to claim 1, wherein a small gap is provided between said brushing portion and said tension applying portion.

3. The hairbrush according to claim 1, wherein bunches of said tension applying portion are implanted to be inclined and a small gap is provided between said tension applying portion and said brushing portion.

4. The hairbrush according to claim 1, wherein said brush base has a semicylindrical shape, said tension applying portion is provided on both side portions of said brush portion, said thin and elastic bristles of each bundle in one tension applying portion are long, and said thin and elastic bristles of each bundle in an other tension applying portion are short.

5. The hairbrush according to claim 4, wherein handle portions are provided on both a tip end side and base end side of said brush base.

6. The hairbrush according to any one of claims 1, 2,3,4 and 5 wherein said bristles of each bundle in said tension applying portion are animal hair and are not cut to a same length.

* * * * *

UNITED STATES PATENT AND TRADEMARK OFFICE

CERTIFICATE OF CORRECTION

PATENT NO. : 6,341,611 B1
DATED : January 29, 2002
INVENTOR(S) : Tetsugi Nakamura It is certified that error appears in the above-identified patent and that said Letters Patent is hereby corrected as shown below:

Title page,
Item [76], Inventor, change "Tetsigi Nakamura" to -- Tetsugi Nakamura --

Signed and Sealed this

Eighth Day of April, 2003

JAMES E. ROGAN
*Director of the United States Patent and Trademark Office*